US006378318B1

(12) United States Patent
Jin

(10) Patent No.: US 6,378,318 B1
(45) Date of Patent: Apr. 30, 2002

(54) HEAT PUMP TYPE AIR CONDITIONING APPARATUS

(76) Inventor: Keum Su Jin, Room 401 Jupung Village, 316-8, Kil-Dong, Kangdong-Ku, Seoul (KR)

( * ) Notice: Subject to any disclaimer, the term of this patent is extended or adjusted under 35 U.S.C. 154(b) by 0 days.

(21) Appl. No.: 09/634,767

(22) Filed: Aug. 9, 2000

(30) Foreign Application Priority Data

May 8, 2000 (KR) ..... 2000-24499

(51) Int. Cl.[7] ..... F25B 27/00
(52) U.S. Cl. ..... 62/238.7
(58) Field of Search ..... 62/238.7

(56) References Cited

U.S. PATENT DOCUMENTS 4,238,933 A * 12/1980 Coombs ..... 62/238 E
4,493,193 A * 1/1985 Fisher ..... 62/160
4,727,727 A * 3/1988 Reedy ..... 62/238.6
4,869,074 A * 9/1989 Hoshi et al. ..... 62/238.7
4,893,476 A * 1/1990 Bos et al. ..... 62/79
5,749,235 A * 5/1998 Ueda ..... 62/160
6,050,102 A 4/2000 Jin
6,138,466 A * 10/2000 Lake et al. ..... 62/199

* cited by examiner

*Primary Examiner*—William Doerrler
*Assistant Examiner*—Mark Shulman
(74) *Attorney, Agent, or Firm*—Hedman & Costigan, P.C.

(57) ABSTRACT

There is disclosed a heat pump type air conditioning apparatus including the construction of a general heat pump type air conditioning apparatus constructed in such a way that a compressor, a four-way valve, an indoor heat exchanger, a pressure reducer for a room cooling operation, another pressure reducer for a room heating operation, an outdoor heat exchanger and the four-way valve are connected one after another by means of a conduit, and the compressor is connected to the four-way valve by means of a suction conduit. The air conditioning apparatus of the present invention is characterized in that two points on the portion of the conduit between the compressor and the four-way valve are connected by means of a bypass. A first heat exchanger is disposed on the bypass. A water heating circuit is provided. A second heat exchanger is disposed on one side of the water heating circuit while being in a heat exchange relation with the first heat exchanger. Radiational heat generating means is disposed on the opposite side of the water heating circuit.

3 Claims, 1 Drawing Sheet

HEAT PUMP TYPE AIR CONDITIONING APPARATUS

BACKGROUND OF THE INVENTION

1. Field of the Invention

The present invention relates, in general, to a heat pump type air conditioning apparatus and, more particularly, to a heat pump type air conditioning apparatus in which a heat pump system is combined with water heating means for radiational heating and hot water supply.

2. Description of the Prior Art

With reference to FIG. 1, a general heat pump type air conditioning apparatus is constructed in such a way that a compressor 1, a four-way valve 2, an indoor heat exchanger 3, a pressure reducer 4 for a room cooling operation, another pressure reducer 5 for a room heating operation, an outdoor heat exchanger 6, and the four-way valve 2 are connected one after another by means of a conduit 7 and the four-way valve 2 is additionally connected to the compressor 1 by means of a suction conduit 7', thus forming a refrigeration circuit.

In the conventional heat pump type air conditioning apparatus, when the four-way valve 2 is manipulated to allow refrigerant to flow in a passage designated by the solid arrows of the drawing for heating a room, there is reiterated a cycle in which high temperature and high pressure refrigerant compressed in the compressor 1 is condensed in the indoor heat exchanger 3 and simultaneously radiates condensation heat to the room air to heat the interior of the room in a convectional manner, the low temperature and high pressure refrigerant liquid is reduced in pressure in the pressure reducer 5 for a heating operation, the refrigerant liquid is evaporated into low temperature and low pressure refrigerant gas in the outdoor heat exchanger 6 utilizing the ambient air as a heat source, and the refrigerant gas is sucked into the compressor 1. On the other hand, when the four-way valve 2 is manipulated to allow refrigerant to flow in a passage designated by the phantom arrows of the drawing for heating a room, there is reiterated a cycle in which high temperature and high pressure refrigerant compressed in the compressor 1 is condensed in the outdoor heat exchanger 6, the low temperature and high pressure refrigerant liquid is reduced in pressure in the pressure reducer 4 for a room cooling operation, the refrigerant liquid reduced in pressure is evaporated into low temperature and low pressure refrigerant gas in the indoor heat exchanger 3 and simultaneously absorbs evaporation heat from the room air to cool a room, and the evaporated refrigerant enters the compressor 1.

In some Asian regions including Korea, an under-floor heating system of a radiational heating fashion has been employed as a room heating system. With the progress of industrialization, there is employed a heating system in which a heat radiating coil is laid under the floor of a room or a radiator heats room air in a convectional heating fashion. Additionally, hot water is used for a bath, etc. regardless of a season.

However, in the conventional heat pump type air conditioning apparatus, the generation of hot water is almost impossible because the indoor heat exchanger 3 has a combined use for the cooling and heating operations, and the temperature difference in between the upper and lower regions of a room is large, noise is great and a user feels discomfort due to a strong air stream in comparison with a hypocaust type radiant heating system or hot water type radiant heating system because air is heated in a convective fashion.

The inventor of this invention has proposed another heat pump type air conditioning apparatus in U.S. Pat. No. 6,050,102, in which a third conduit is connected to the first conduit of the refrigeration circuit of a general heat pump type air conditioning apparatus to bypass an indoor heat exchanger, a condenser is disposed in the third conduit and a water heating tub is in the vicinity of the condenser.

However, in the heat pump type air conditioning apparatus according to the patented invention, since the water heating tub is disposed behind the four-way valve, there occur disadvantages in which hot water is generated during only a heating operation and water heating efficiency is low.

SUMMARY OF THE INVENTION

Accordingly, the present invention has been made keeping in mind the above problems occurring in the prior art, and an object of the present invention is to provide a heat pump type air conditioning apparatus, which is capable of providing desirable heating in both convectional and radiational fashions and generating hot water for a bath, etc. regardless of a season.

In order to accomplish the above object, the present invention provides a heat pump type air conditioning apparatus constructed in such a way that a compressor, a four-way valve, an indoor heat exchanger, a pressure reducer for a room cooling operation, another pressure reducer for a room heating operation, an outdoor heat exchanger and the four-way valve are connected one after another by means of a conduit, and the compressor is connected to the four-way valve by means of a suction conduit, characterized in that two points on the portion of the conduit between the compressor and the four-way valve are connected by means of a bypass, a first heat exchanger is disposed on the bypass, a water heating circuit is provided, a second heat exchanger is disposed on one side of the water heating circuit while being in a heat exchange relation with the first heat exchanger, and radiational heat generating means is disposed on the opposite side of the water heating circuit.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
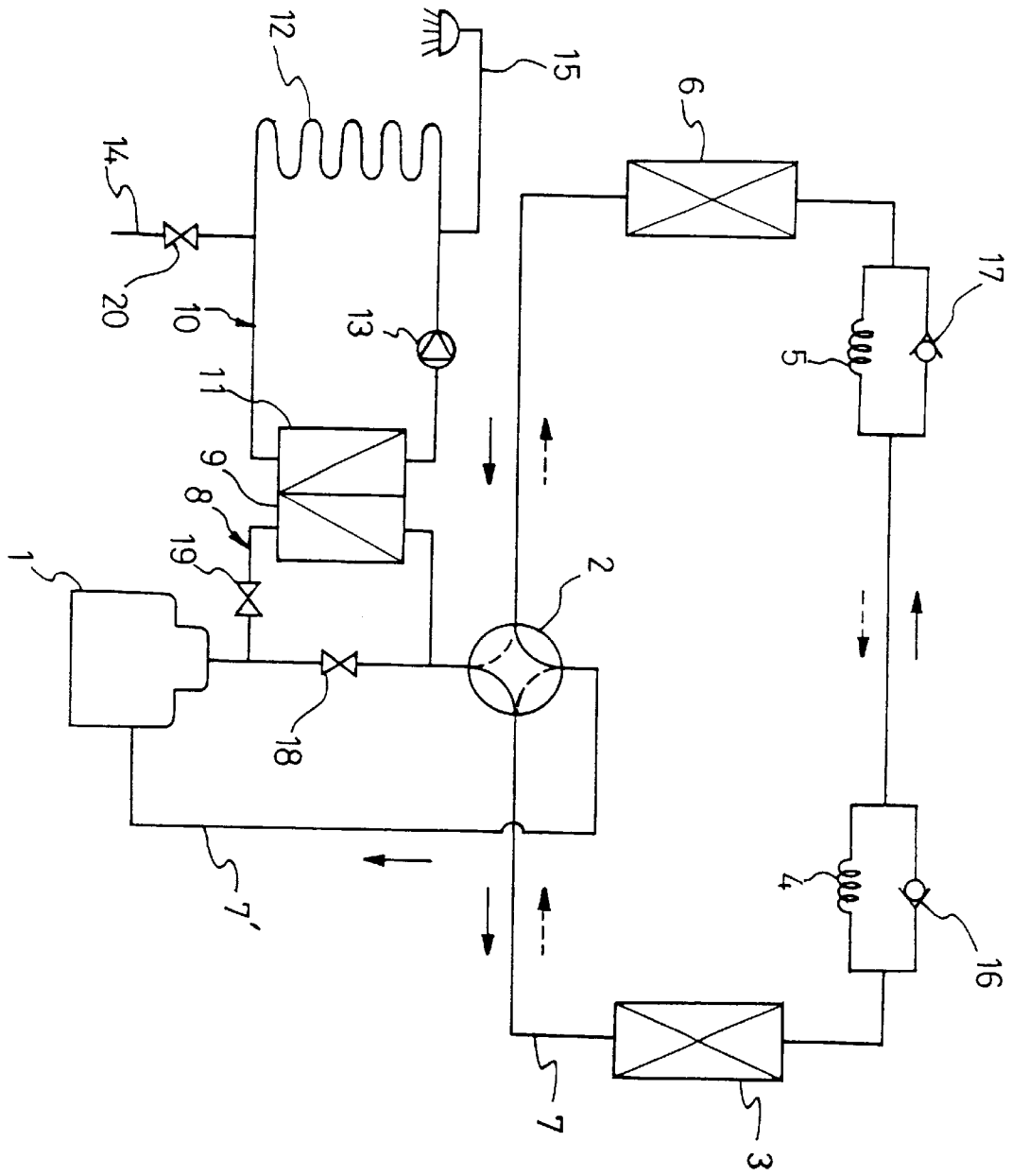
FIG. 1 is a schematic diagram showing the construction of a heat pump type air conditioning apparatus in accordance with a preferred embodiment of the present invention.

FIG. 1 is a schematic diagram showing the arrangement of a heat pump type air conditioning apparatus in accordance with a preferred embodiment of the present invention.

The heat pump type air conditioning apparatus includes the construction of a general heat pump type air conditioning apparatus in which a compressor 1, a four-way valve 2, an indoor heat exchanger 3, a pressure reducer 4 for a room cooling operation, another pressure reducer 5 for a room heating operation, an outdoor heat exchanger 6, and the four-way valve 2 are connected one after another by means of a conduit and the four-way valve 2 is additionally connected to the compressor 1 by means of a suction conduit 7', thus forming a refrigeration circuit. In the general heat pump construction, for a heating operation, refrigerant is circulated along a pass designated by solid arrows of the drawing and the indoor heat exchanger 3 functions as a condenser. On the other hand, for a cooling operation, refrigerant is circulated along another pass designated by phantom arrows of the drawing and the indoor heat exchanger 3 functions as an evaporator.

Reference numeral 8 designates a bypass. The bypass 8 connects to each other two points on the portion of the conduit 7 between the compressor 1 and the four-way valve 2. A first heat exchanger 9 functioning as a condenser is disposed on the bypass 8.

Reference numeral 10 designates a water heating circuit. A second heat exchanger 11 in a heat exchange relation with the first heat exchanger 9 is disposed on one side of the water heating circuit 10, means 12 for generating radiational heat, such as a heat radiating coil or radiator, laid under the floor of a room is disposed on the opposite side of the water heating circuit 10, and a circulation pump 13 is disposed on the water heating circuit 10 at a position between the second heat exchanger 11 and the radiational heat generating means 12. In the water heating circuit 10 on which all the above-described parts are disposed, water is heated in the second heat exchanger 11 by means of condensation heat generated by the first heat exchanger 9, and the heated water is circulated toward the radiational heat generating means 12 by means of the circulation pump 13.

A water supply conduit 14 and a hot water discharge conduit 15 are respectively connected to the water heating circuit 10, so that water is supplied to the water heating circuit 10 through the water supply conduit 14 and water heated in the second heat exchanger 11 is supplied through the hot water discharge conduit 15 for a bath or other use.

Reference numerals 16 and 17 designate check valves, and reference numerals 18, 19 and 20 designate valves.

In the heat pump type air conditioning apparatus of the present invention, for a heating operation, when the compressor 1 is operated after the valves 18 and 19 are opened and the four-way valve 2 is manipulated to allow refrigerant to flow in a passage designated by the solid arrows of the drawing, there is reiterated a cycle in the general hat pump construction, in which refrigerant is compressed into high temperature and high pressure refrigerant gas in the compressor 1, the compressed refrigerant is supplied to the indoor heat exchanger 3 through four-way valve 2, the supplied refrigerant gas is condensed into refrigerant liquid in the indoor heat exchanger 3 functioning as a condenser and simultaneously radiates condensation heat to the room air to heat a room in a convectional fashion, the low temperature and high pressure refrigerant liquid passes through the check valve 16 and is reduced in pressure in the pressure reducer 5 for a heating operation, the refrigerant liquid reduced in pressure is evaporated into low temperature and low pressure refrigerant gas in the outdoor heat exchanger 6 utilizing the ambient air as a heat source, and the low temperature and low pressure refrigerant gas passes through the four-way valve 2 and is sucked into the compressor 1.

In addition, the high temperature and high pressure refrigerant gas heats water flowing through the second heat exchanger 11 in a heat exchange relation with the first heat exchanger 9 while passing through the bypass 8, and the heated water heats room air by means of the emission of radiational heat in a radiational fashion while being circulated through the radiational heat generating means 12. Accordingly, since the room air is heated in both convectional and radiational fashions, the difference in room temperature can be eliminated.

During the simultaneous performance of the convectional and radiational heating, if the amount of the radiational heat radiated from the radiational heat generating means 12 is increased by increasing the degree of the opening of the valve 19 and accordingly increasing the amount of the refrigerant flowing through the bypass 8, and the amount of the convectional heat is reduced by reducing the amount of the refrigerant gas and simultaneously the number of rotations of a fan (not shown) is reduced, noise is reduced and air stream becomes weak, thereby realizing comfortable heating.

On the other hand, for a cooling operation, when the compressor 1 is operated after the valve 18 is opened, the valve 19 is closed and the four-way valve 2 is manipulated to allow refrigerant to flow in a passage designated by the phantom arrows of the drawing, there is reiterated a cycle in the general heat pump construction, in which refrigerant is compressed into high temperature and high pressure refrigerant gas in the compressor 1, the high temperature and high pressure refrigerant gas passes through the four-way valve 2 and is condensed into refrigerant liquid in the outdoor heat exchanger 6 functioning as a condenser, the refrigerant liquid passes through the check valve 17 and is reduced in pressure in the pressure reducer 5 for a room cooling operation, the refrigerant liquid reduced in pressure is evaporated in the indoor heat exchanger 3 functioning as an evaporator and simultaneously absorbs evaporation heat from the room air to cool the room air, and the evaporated refrigerant gas passes through the four-way valve 2 and is sucked into the compressor 1.

In addition, during the above-described cooling operation, if a portion of the high temperature and high pressure refrigerant gas compressed in the compressor 1 is allowed to flow through the bypass 8 and simultaneously water is supplied to the water heating circuit 10, water is heated in the second heat exchanger 11 in a heat exchange relation with the bypass 8, thereby not only heating the room but also generating hot water. At this time, the first heat exchanger functions as a condenser the same as the outdoor heat exchanger 6, so that the condensation of the refrigerant gas is performed sufficiently, thereby improving the cooling efficiency.

Furthermore, the bypass 8 is disposed between the compressor 1 and the four-way valve 2, water is heated by means of the high temperature and high pressure refrigerant gas discharged from the compressor 1, thereby improving hot water heating efficiency, and simplifying the piping of the air conditioning apparatus in comparison with the conventional heat pump type air conditioning apparatus in which a water heating bath is disposed behind a four-way valve.

In accordance with the present invention, convectional air conditioning and radiational air conditioning can be performed at the same time, so that the difference in room temperature is reduced, noise is decreased and air stream becomes weak, thereby realizing a comfortable heating.

Additionally, hot water can be generated during a cooling operation and a heating operation, water heating efficiency is superior, and heating efficiency is increased due to the superior condensation of coolant gas during a cooling operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat pump type air conditioning apparatus constructed in such a way that a compressor, a four-way valve, an indoor heat exchanger, a pressure reducer for a room cooling operation, another pressure reducer for a room heating operation, an outdoor heat exchanger and the four-way valve are connected one after another by means of a conduit, and the compressor is connected to the four-way valve by means of a suction conduit, characterized in that two points on a portion of the conduit between the compressor and the four-way valve are connected by means of a bypass, a first heat exchanger is disposed on the bypass, a water heating circuit is provided, a second heat exchanger is disposed on one side of the water heating circuit while being in a heat exchange relation with the first heat exchanger, and radiational heat generating means is disposed on an opposite side of the water heating circuit.

2. The air conditioning apparatus according to claim 1, wherein a water supply conduit and a hot water discharge conduit are respectively connected to said water heating circuit at their one side ends.

3. The air conditioning apparatus according to claim 1, wherein said radiational heat generating means is a heat radiating coil or radiator.

* * * * *